United States Patent [19]

Zerobnick et al.

[11] 4,029,243

[45] June 14, 1977

[54] INTEGRATED BELT-SUPPORTED BACKPACK

[75] Inventors: Alan H. Zerobnick, Estes Park; David J. Cole, Denver, both of Colo.

[73] Assignee: Samuel Zerobnick, Denver, Colo.

[22] Filed: Feb. 28, 1975

[21] Appl. No.: 553,930

[52] U.S. Cl. ..... 224/8 R; 224/26 C

[51] Int. Cl.[2] ..... A45F 3/00

[58] Field of Search ..... 224/8 R, 26 C, 26 R, 224/26 E, 5 R, 5 A, 5 B, 13, 14, 22, 23, 24; 2/DIG. 6, 44, 2, 317, 321, 322; D2/381, 383, 380; D87/1 R

[56] References Cited

UNITED STATES PATENTS

| | | | |
|---|---|---|---|
| 656,666 | 8/1900 | Scheuer | 2/321 |
| 1,010,763 | 12/1911 | Hogan | 224/5 A |
| 2,661,888 | 12/1953 | Sidlinger | D2/380 X |
| 2,792,980 | 5/1957 | Brown | 224/8 R |
| 3,190,513 | 6/1965 | Wheeler | 224/5 R |
| 3,664,560 | 5/1972 | Perkins | 224/26 R X |

FOREIGN PATENTS OR APPLICATIONS

| | | | |
|---|---|---|---|
| 103,628 | 6/1926 | Austria | 224/26 C |
| 796,766 | 4/1936 | France | 224/26 C |
| 153,350 | 5/1938 | Germany | 224/26 C |
| 443,655 | 2/1926 | Germany | 224/22 |
| 238,070 | 9/1945 | Switzerland | 224/26 C |

*Primary Examiner*—Robert J. Spar
*Assistant Examiner*—Jerold M. Forsberg
*Attorney, Agent, or Firm*—John E. Reilly

[57] ABSTRACT

A belt-supported backpack has been devised which is adapted to be worn around a person's waist and fully supported over the pelvic region of the wearer so as to avoid necessity of cumbersome frames or shoulder straps. The belt proper is formed of an elongted flexible length of material which has forwardly tapering free ends adapted to be releasably secured together and the intermediate portion of the belt forms the inner wall or lining of the backpack or main compartment of the backpack. Most desirably, the main compartment has a releasable closure along the sides and top to permit it to be fully opened, and an auxiliary compartment on the outer wall of the main compartment has separate releasable closures which open into a common interior. One of the releasable closures on the side of the auxiliary compartment is so constructed and arranged as to permit ready opening by the wearer simply by reaching behind and forcing open with the hand without necessity of releasing the belt. Reinforcement straps are also provided on the belt to cooperate in securely fastening the belt around the waist.

8 Claims, 6 Drawing Figures

INTEGRATED BELT-SUPPORTED BACKPACK

This invention relates to backpacks adapted for carrying equipment and supplies and more particularly relates to a belt-supported pack of unitary construction which is adapted to be worn around a person's waist for carrying equipment and supplies, such as, for example, in hiking, climbing and other related outdoor activities.

BACKGROUND OF THE INVENTION

It has been customary in the past to provide backpacks for carrying supplies and equipment which were generally designed to be suspended on a person's back by means of shoulder straps. In addition, lightweight aluminum frames have been employed as an additional means of support for backpacks, or so-called knapsacks, in order to more evenly distribute the laod on a person's back while maintaining the desired maneuverability, accessibility and comfort. Any number of backpacks have been devised or utilized in the past, such as the over-the-shoulder sacks, Duluth-type packs complete with tumplines, heavy rucksacks, frame packs, pack frames, and bag combinations, just to name a few. For many uses, however, backpacks presently in commercial use are unduly cumbersome and bulky, limit maneuverability, and after extended periods of wear tend to become very uncomfortable. Moreover, packs presently in use do not provide ready accessibility to any of the compartments without removal of the pack from the back.

In addition, various type of utility belts have been devised with pockets or small compartments to permit carrying of smaller articles or equipment. By and large, such belts have not been so constructed as to provide relatively large compartments or packs which would permit stowing of camping or hiking gear and particularly stowing of relatively bulky objects such as food, blankets, tents or the like.

SUMMARY OF THE INVENTION

It is therefore an object of the present invention to provide a novel and improved belt-supported pack which has sufficient volume to carry the necessary hiking or camping equipment and supplies while being compact enough to be worn around the waist without need for shoulder straps or other accessory support whereby to offer increased maneuverability and convenience to the user.

It is another object of the present invention to provide for a novel and improved belt-supported backpack of unitary construction which greatly facilitates accessibility to its contents while distributing the contents in large compartments centered over the lower pelvic region of the back.

It is a further object of the present invention to provide a belt pack which can be worn with increased comfort and is capable of distributing relatively heavy loads over a wide area when worn; and further wherein the pack is provided with improved fastening means to evenly distribute a load while assuring that the pack will be snugly retained in place.

It is an additional object of the present invention to provide for a novel and improved belt-supported backpack of unitary construction which affords optimum stress distribution, durability and economy in manufacture and specifically wherein the entire pack is formed as a unitary part of the intermediate portion of the belt so that it can be properly centered and distributed over the pelvic region of the wearer and so as not to unduly restrict freedom of movement of the wearer.

The belt-supported backpack of the present invention has been devised to satisfy more contemporary needs of the modern outdoorsman and is broadly comprised of a multi-compartment backpack, the compartments preferably being superimposed upon one another and affixed to the intermediate section of a one-piece belt, all assembled into a unitary construction in which the intermediate section of the belt forms the inner wall or lining of the main compartment of the backpack and can be adjustably but securely fastened and worn around the person's waist with the contents or load of the pack evenly distributed over the pelvic region. By virtue of the unitary construction between the relatively wide intermediate or back portion of the belt with the backpack the weight of the pack and its contents is evenly distributed over a large area of the wearer's lower back or pelvic region without developing undue stress either in the pack or belt at any point around the wearer's waist. Moreover, since the pack is worn around the waist, as opposed to suspension from the shoulders or upper back region, it will ride much closer to the body and be effectively lighter in weight than the conventional packs; and further, by shifting the weight to a lower point or region of the back, there will be less tendency to lose one's balance and less strain placed upon the back.

Still another feature of the present invention resides in the construction and arrangement of the main compartment and a superimposed auxiliary compartment which make up the backpack. At least one auxiliary compartment is formed in the outer wall of the main compartment and is provided with a releasable closure which will permit access to items in the compartment without removal or shifting of the pack. The auxiliary compartment as well as the main compartment most desirably traverse the entire length and width of the intermediate or wider portion of the belt and the auxiliary compartment includes an upper access opening extending for its entire length. The main compartment also includes a releasable closure preferably in the form of a zipper which extends continuously along the upper half of the compartment.

Other objects, advantages and features of the present invention will become more readily appreciated and understood from a consideration of the following detailed description of the preferred embodiment of the present invention when taken together with the accompanying drawings, in which:

DESCRIPTION OF THE PREFERRED EMBODIMENT

Figure 1:
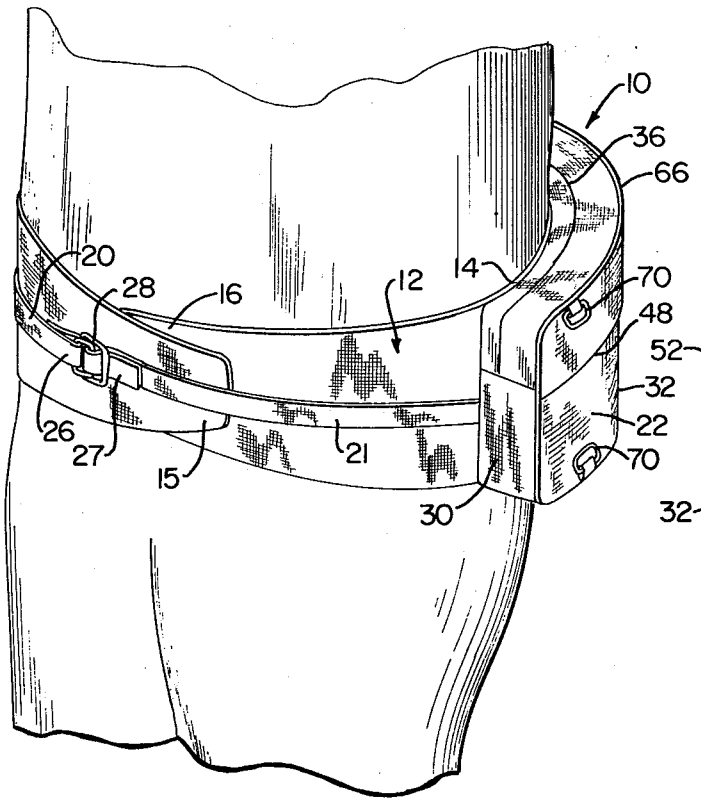
FIG. 1 is a perspective view of the waist belt-supported pack of the present invention shown in position on a person's waist in accordance with the present invention.
Figure 3:
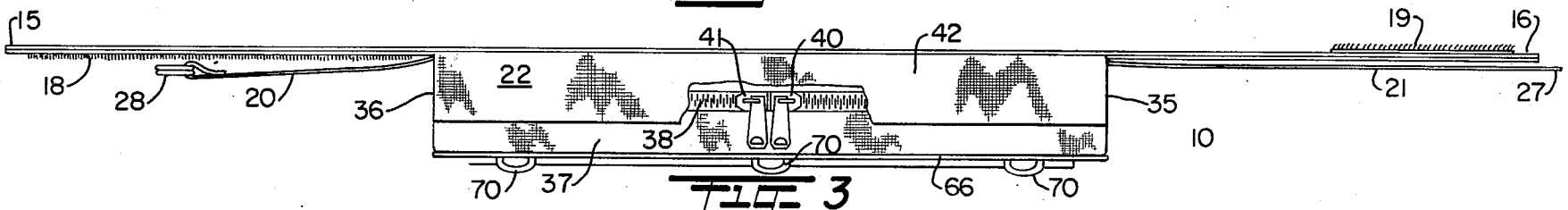
FIG. 3 is a plan view of the belt pack with the free ends of the belt extended to show the unitary construction of the invention and with a portion of the zipper cover flap cut away to indicate accessibility to the inner compartment with its dual zipper construction.

Referring in more detail to the drawings, a preferred form of belt-supported back 10 is shown in FIG. 1 positioned around the waist portion of a person represented at P. Broadly, the pack 10 in accordance with the present invention is comprised of a belt 12 having a relatively wide intermediate section 14 which merges at opposite ends into forwardly tapered sections of free ends 15 and 16. Each of the free ends 15 and 16 is provided with fastener means 18 and 19, respectively, as shown in FIG. 3 for adjustably and releasably securing the free ends together around a person's waist with the relatively wide intermediate section 14 passing around the lower back or pelvic region. A pack 22 comprises a large inner or main compartment 30 and a smaller outer or auxiliary compartment 32, the pack 22 being affixed directly to the intermediate section 14 so as to traverse its entire length and width. Reinforcing or safety straps 20 and 21 have free ends 26 and 27 provided with fastener means 28 therebetween to cooperate with the free ends 15 and 16 in supporting the pack 10 around the waist.

Figure 5:
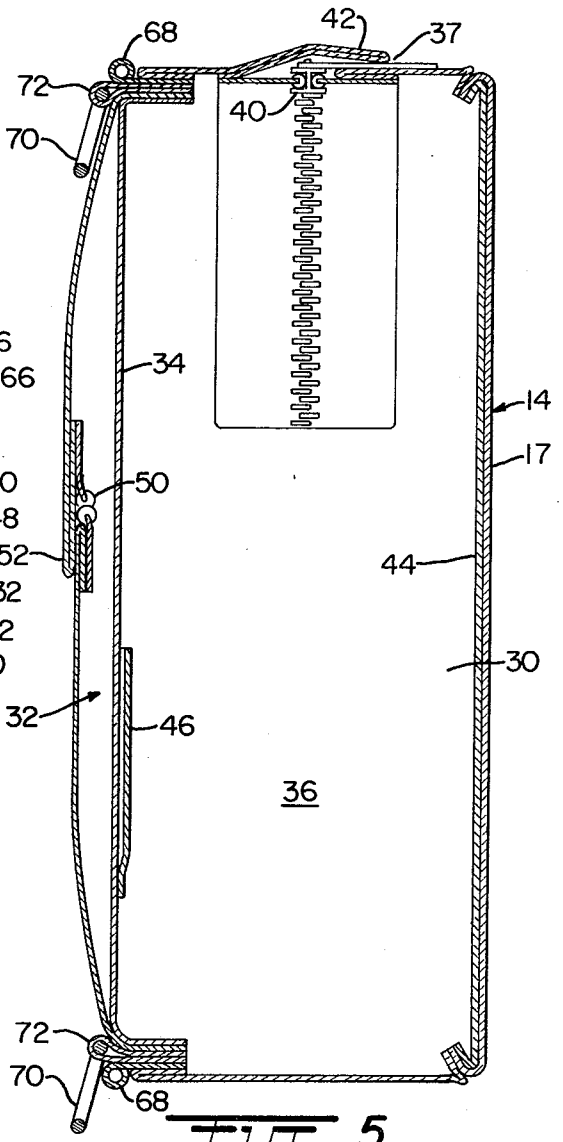
FIG. 5 is a vertical transverse sectional view of the waist belt pack taken substantially on the plane 5—5 of FIG. 2.

Considering in more detail the features of construction and arrangement of the belt pack 10 of the present invention, the belt 12 consisting of the intermediate section 14 and opposite free ends 15 and 16 is defined by a single elongated length of flexible material or synthetic fabric material, although it may also be readily composed of leather or imitation leather. In the preferred form as shown, the free ends 15 and 16 are composed of an outer layer of synthetic fabric such as Nylon, which is stitched or seamed to an inner continuous layer or lining of a heavyweight fabric as represented at 17 in FIG. 5. As seen, the inner layer 17 is a single continuous length of material, and outer layers 17' are stitched along the free ends of the inner layer or lining 17. The free ends 15 and 16 are adapted to be secured together by the fastener means 18 and 19, the fastener means preferably being defined by "velcro" fastener strips consisting of a first strip of thistle cloth pile 18 affixed to the outside of the free end 15 of the belt 12 and a second strip of thistle cloth hooks 19 affixed to the inside of the free ends 16 of belt 12. In this way when the belt is wrapped around the person's waist, the thistle cloth hooks 19 can be brought into engagement with the thistle cloth pile 18 to securely fasten the free ends 15 and 16 together. Thus, the fastener means as described enables the entire pack to be quickly and easily fastened and to be readily adjustable according to the weight and size of the individual.

The reinforcement of safety straps 20 and 21 each has one end attached to the belt adjacent to one side of the main compartment 30 so that the opposite free ends of the strap may be brought together and secured by suitable means over the free ends 15 and 16 of the belt. For instance, a double D-ring fastener represented at 28 on the free end of the strap 21 will receive the free end 27 of the other strap 20 to secure the strap 20 and 21 together over the free ends 15 and 16. For reasons to become more apparent, the reinforcement straps 20 and 21 merely aid the fastener means 18 and 19 on the free ends 15 and 16 in securing heavy loads and, if desired, need not be utilized in all cases since the free ends 15 and 16 normally will be capable of supporting most loads when secured together in the manner described.

Figure 2:
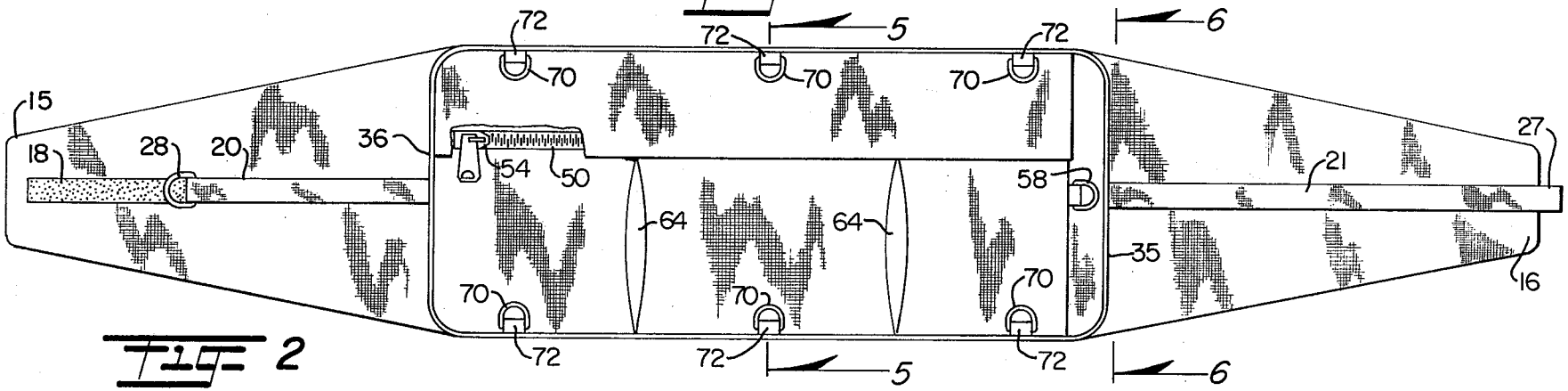
FIG. 2 is a rear elevation view of the belt pack with free ends of the belt extended showing the general features and outside appearance of the preferred form of invention.

The backpack 22 is preferably composed of a fabric or synthetic fabric material and is permanently affixed to the intermediate section 14 of the belt so as to traverse its entire length and width. In the preferred form, the pack 22 has the larger inner or main compartment 30 which is of generally rectangular configuration when the free ends are extended, as shown in FIGS. 2 and 3, and comprises opposite side walls 35 and 36, an upper wall or section 37, a bottom wall or section 38, and an outer wall 34 in spaced parallel relation to the inner wall or lining 17. Access is provided into the inner or main compartment 30 by a releasable closure defined by a zipper 40 extending intermediately along the upper half of each of the opposite sides 35 and 36 and upper wall 37 with zipper closures 41 and 42 which will open the zipper 40 to any desired degree by advancing from the center closed position shown in FIG. 3 along the top wall 37 and downwardly along each side wall 35 and 36. In this way, the inner compartment can be opened along the top and portions of the sides for access into the interior of the compartment. In the alternative, the zipper 40 can be extended downwardly along the sides 35 and 36 so that the main compartment 30 can be fully opened very much in the manner of a suitcase in order to facilitate packing or unpacking of its contents.

Figure 4:
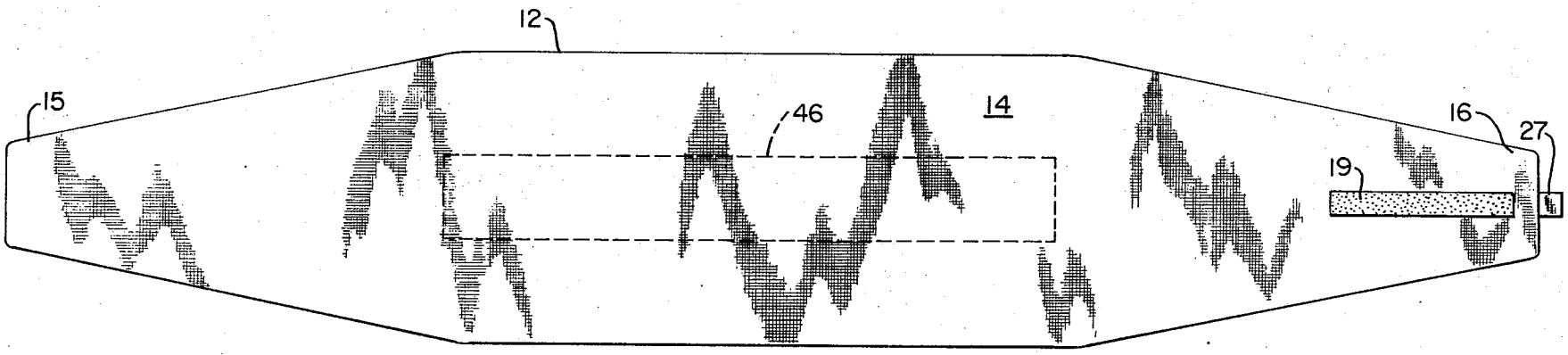
FIG. 4 is a front elevational view of the belt pack with the free ends of the belt extended so as to show its unitary construction and general inside appearance.

Inorder to protect the zipper section, a flap 42 may be sewn into the top and side walls of the main compartment so as to completely cover the zipper 40. The flap is also formed of a fabric or other flexible material so as to permit it to be folded away from the zipper 40 in operating the closers 41 and 42. If desired, a foam cushion pad 44 may be affixed to the outer surface of the intermediate section 14 within the compartment 30 to provide a cushion between the belt and the contents of the pack. Also, a series of pockets 46 shown dotted in FIG. 4 are attached to extend along the length of the outer wall 39 within the main compartment to facilitate storage of smaller items, such as, utensils or tools within the compartment.

In the preferred form, an auxiliary compartment 32 has a single generally rectangular wall section 48 which is affixed around three sides of its outer periphery to the edges of the outer wall 34. An access opening is formed to extend horizontally along the upper part of the wall section 48 by a releasable closure in the form of a zipper 50 with closer 51, and a flap 52 covers the zipper 50.

Additionally, a side access opening 54 is formed between one side of the wall section 48 and the outer wall 34 by a releasable closure preferably in the form of a Velcro fastener comprising a strip of thistle cloth hooks 55 on the inner surface of the wall section 48 and a strip of thistle cloth pile 56 on the external surface of the outer wall 34 aligned with the strip 55. Normally, the opening 54 is closed by pressing the strips 55 and 56 together and is opening merely by forcing the strip apart with the hand. This can be facilitated by use of a D-ring handle 58 which is attached to the side edge of the wall section 48 adjacent to the strip 55. Accordingly, access is provided to the auxiliary compartment 32 through either access opening, although the side access opening 54 is intended more to permit ready entry into the compartment simply by reaching back with one hand to remove articles without removal of the pack from the waist.

The wall section 48 also may be suitably composed of a natural or synthetic fabric material and, to afford increased capacity or space for expansion of the compartment, may be pleated as at portions 64, shown in FIG. 2.

The outer edges or seams formed between the compartments 30 and 32 includes an outer protective bead 66 which protects the edges from wear or damage and reinforces the entire pack. D-ring fasteners 70 are attached by short straps 72 at equally spaced intervals along the upper and lower edges of the wall section 48. The fasteners 70 are specifically adapted for securing of bulky items to the outside of the pack.

It is significant that the belt 12 is formed in one piece with a wide back section 14, and that the pack 22 is affixed to the wide back section 14. Such construction effectively distributes the weight of the pack and its contents over a wide portion of the user's back and minimizes or eliminates any localized stress. The wide back section 14 also distributes the weight of the pack more into the user's hips and pelvic region rather than transferring uncomfortable stress to the user's front torso area.

Figure 6:
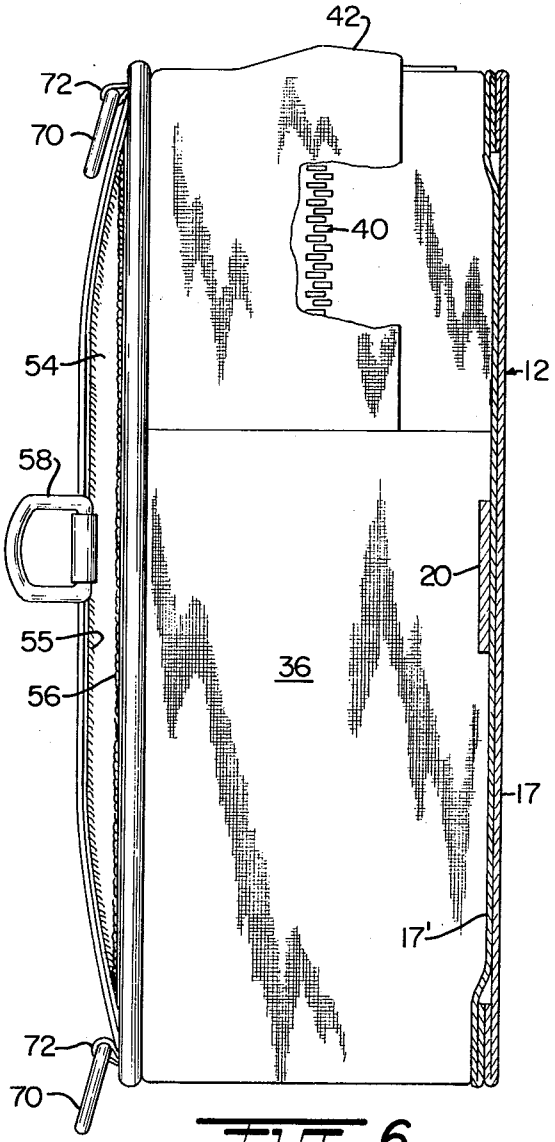
FIG. 6 is a vertical transverse sectional view of the waist belt pack taken substantially on the plane 6—6 of FIG. 2.

The belt 12 is preferably formed of a heavy, cotton canvas material which is rigid enough to distribute the weight of the pack 22 evenly while maintaining flexibility. Such material also enhances comfort by absorbing moisture and "breathing" to retard perspiration. The outer covering of waterproof, lightweight cotton fabric 17' or the same type of fabric used for construction of the pack 22 is provided on the outside surface of belt 12 to enhance its appearance and increase durability as seen in FIG. 6.

The pack assembly is dimensioned such that pack 22 is of a length greater than the length of either of the free ends 15 or 16 and where the total length of the belt is on the order of 42 to 62 inches. The intermediate section 14 is approximately three times the width of the extremities of the free ends 15 or 16, or on the order of 6 to 8 inches. Further, the thickness is approximately 3 to 4 inches including the added expansion afforded by the auxiliary compartment 32.

Although the present invention has been described with particularity relative to the foregoing exemplary preferred embodiment, various changes, modifications, applications and additions will be readily apparent to those having normal skill in the art without departing from the spirit of this invention as described by the appended claims.

What is claimed is:

1. A belt-supported backpack adapted to be worn around a person's waist, comprising in combination:

an elongated flexible belt of unitary construction consisting of a relatively wide intermediate section and forwardly tapered free ends extending away from opposite ends of said intermediate section, fastener means at the free ends of said belt for releasably and adjustably securing said free ends together, a flexible pack including a main compartment affixed to the intermediate section of said belt, said intermediate section of said belt defining the inner wall of said main compartment, said compartment traversing the entire width and length of said intermediate section, said main compartment having inner and outer walls separated by opposite sides, top and bottom walls interconnecting said inner and outer walls in spaced parallel relation to one another, and an access opening into the interior of said main compartment extending continuously across said top wall and at least the upper portions of said opposite side walls, an auxiliary compartment affixed to the external surface of the outer wall of said main compartment and substantially coextensive with said main compartment, said auxiliary compartment provided with an upper access opening into said auxiliary compartment, a releasable closure across said upper opening, and a separate side access opening into said auxiliary compartment including a separate releasable closure therefor, and said belt being sized to be fastened around a person's waist with the wider intermediate section of said belt curving around the lower back and terminating on opposite sides of the person's waist, said main compartment conforming to the contour of said intermediate section when worn around a person's waist.

2. A backpack according to claim 1 including a pair of reinforcement strap means each having a fixed end attached to said belt adjacent to said intermediate sections and a free end, and each strap means having a free strap end adapted for releasable and adjustable connection to the other respective free strap end.

3. A backpack according to claim 1 including a plurality of ring members affixed along the upper and lower edges of the outer wall of said main compartment.

4. A belt-supported backpack according to claim 2 wherein said fastener means comprises a strip of thistle cloth pile affixed to the outside of one of said free ends and a strip of thistle cloth hooks affixed to the inside of the remaining free end of said belt whereby said free ends are releasably and adjustably secured together by applying pressure to engage said thistle cloth hooks with said thistle cloth pile.

5. A belt-supported backpack according to claim 1 wherein said access openings for said main compartment includes a zipper member for opening and closing said access opening, and said auxiliary side access opening includes a body of thistle cloth pile and a body of thistle cloth hooks for engaging said pile affixed to opposing surfaces of said auxiliary side access opening for releasably securing said auxiliary side access opening in closed position.

6. A unitary belt-supported backpack adapted to be worn around a person's waist, comprising in combination:

a belt having a single elongated flexible length of material including a wide intermedite section and forwardly tapered free ends, fastener means at the free ends of said belt for releasable and adjustably securing said free ends together around the person's waist, a pair of reinforcement strap means each having a fixed end attached to said belt between said intermediate sections and a free end, and each strap means having a free strap end adapted for releasable and adjustable connection to the other respective free strap end, a flexible pack including a main compartment affixed along the intermediate section of said belt, said intermediate section of said belt defining the inner wall of said main compartment, said compartment traversing the entire width and length of said intermediate section, said compartment having an outer wall and opposite sides, top and bottom walls interconnecting said inner and outer walls, and an access opening into the interior of said main compartment, an auxiliary compartment affixed to the external surface of the outer wall of said main compartment, said auxiliary compartment provided with an upper access opening into said auxiliary compartment, a releasable closure across said upper opening, and a separate side access opening into said auxiliary compartment including a separate releasable closure therefor, and a plurality of ring members affixed along the upper and lower edges of the outer wall of said main compartment.

7. A belt-supported backpack according to claim 6, said belt being sized to be fastened around a person's waist with the wider intermediate section of said belt curving around the pelvic region and terminating on opposite sides of the person's waist, said main compartment conforming to the contour of said intermediate section when worn around a person's waist.

8. A belt-supported backpack according to claim 7 wherein said belt fastener means comprises a strip of thistle cloth pile affixed to the outside of one of said free ends and a strip of thistle cloth hooks affixed to the inside of the remaining free end of said belt whereby said free ends are releasably and adjustably secured together by applying pressure to engage said thistle cloth hooks with said thistle cloth pile.

* * * * *

UNITED STATES PATENT OFFICE

CERTIFICATE OF CORRECTION

Patent No. 4,029,243 Dated June 14, 1977

Inventor(s) Alan H. Zerobnick et al.

It is certified that error appears in the above-identified patent and that said Letters Patent are hereby corrected as shown below:

Column 1, line 17, cancel "laod" and substitute -- load --.

Column 3, line 16, cancel "of" and substitute -- or --.

Column 3, line 59, cancel "of" and substitute -- or --.

Column 4, line 33, cancel "Inorder" and substitute -- In order --.

Column 4, line 58, cancel "Velcro" and substitute -- "Velcro" --.

Claim 6, Column 6, line 56, cancel "intermedite" and substitute -- intermediate --.

Claim 6, Column 6, lines 58 and 59, cancel "releasable" and substitute -- releasably --.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*